US011120963B2

(12) United States Patent
Ziegler

(10) Patent No.: US 11,120,963 B2
(45) Date of Patent: Sep. 14, 2021

(54) DOUBLE BREAKER SWITCH

(71) Applicant: TE Connectivity Germany GmbH, Bensheim (DE)

(72) Inventor: Titus Ziegler, Berlin (DE)

(73) Assignee: TE Connectivity Germany GmbH, Bensheim (DE)

( * ) Notice: Subject to any disclaimer, the term of this patent is extended or adjusted under 35 U.S.C. 154(b) by 263 days.

(21) Appl. No.: 16/193,520

(22) Filed: Nov. 16, 2018

(65) Prior Publication Data

US 2019/0148096 A1 May 16, 2019

(30) Foreign Application Priority Data

Nov. 16, 2017 (DE) ..... 102017220503.2

(51) Int. Cl.

| | |
|---|---|
| ***H01H 3/00*** | (2006.01) |
| ***H01H 50/54*** | (2006.01) |
| *H01H 1/023* | (2006.01) |
| *H01H 9/44* | (2006.01) |
| *H01H 51/06* | (2006.01) |
| *H01H 73/04* | (2006.01) |

(Continued)

(52) U.S. Cl.

CPC ..... *H01H 50/546* (2013.01); *H01H 1/023* (2013.01); *H01H 1/20* (2013.01); *H01H 1/24* (2013.01); *H01H 9/44* (2013.01); *H01H 50/38* (2013.01); *H01H 51/065* (2013.01); *H01H 73/045* (2013.01); *H01H 2201/024* (2013.01); *H01H 2203/024* (2013.01); *H01H 2203/05* (2013.01)

(58) Field of Classification Search

USPC ..... 335/185

See application file for complete search history.

(56) References Cited

U.S. PATENT DOCUMENTS 2,783,340 A * 2/1957 Davies ..... H01H 51/065 200/243

3,103,563 A * 9/1963 Grenier ..... H01H 71/501 335/145

(Continued)

FOREIGN PATENT DOCUMENTS

| | | | |
|---|---|---|---|
| DE | 4315754 | A1 | 11/1994 |
| EP | 2690642 | A1 | 1/2014 |
| WO | 2014093045 | A1 | 6/2014 |

OTHER PUBLICATIONS

German Office Action, dated May 24, 2018, 6 pages.

(Continued)

*Primary Examiner* — Shawki S Ismail
*Assistant Examiner* — Lisa N Homza
(74) *Attorney, Agent, or Firm* — Barley Snyder

(57) ABSTRACT

A double breaker switch comprises a contact bridge connected to an actuator at a connection point, a first fixed contact, and a second fixed contact. The contact bridge includes a first bridge contact connected to the connection point by a first arm and a second bridge contact connected to the connection point by a second arm. The second arm is longer than the first arm. The first bridge contact electrically connects with the first fixed contact at a first contact point in a closed state of the double breaker switch. The second bridge contact electrically connects with the second fixed contact at a second contact point and a third contact point in the closed state of the double breaker switch.

20 Claims, 8 Drawing Sheets

(51) Int. Cl.

| | |
|---|---|
| *H01H 1/20* | (2006.01) |
| *H01H 1/24* | (2006.01) |
| *H01H 50/38* | (2006.01) |

(56) References Cited

U.S. PATENT DOCUMENTS 3,852,544 A * 12/1974 Grunert ..... H01H 3/24 200/82 R
4,801,909 A * 1/1989 Fasola ..... H01H 1/20 335/126
4,931,757 A * 6/1990 Lemmer ..... H01H 89/06 335/131
5,256,992 A * 10/1993 Fasola ..... H01H 51/065 335/126
5,424,700 A * 6/1995 Santarelli ..... H01H 1/06 335/126
5,502,426 A * 3/1996 Blanchard ..... H01H 71/56 335/132
5,517,167 A * 5/1996 Yamamoto ..... H01F 5/04 335/132
5,638,038 A * 6/1997 Suzuki ..... H01H 9/542 335/35
5,680,084 A * 10/1997 Kishi ..... H01H 1/66 335/151
5,703,551 A * 12/1997 Lefebvre ..... H01H 51/065 335/126
5,959,517 A * 9/1999 Wieloch ..... H01H 81/04 218/22
6,320,485 B1 * 11/2001 Gruner ..... H01H 50/546 335/132
6,377,143 B1 * 4/2002 Zhou ..... H01H 50/546 218/154
6,486,762 B2 * 11/2002 Kurasawa ..... H01H 51/065 335/202
6,911,884 B2 * 6/2005 Uotome ..... H01H 47/06 335/132
6,943,654 B2 * 9/2005 Zhou ..... H01H 9/563 335/106
7,196,434 B2 * 3/2007 Zhou ..... H01H 50/546 307/131
7,317,264 B2 * 1/2008 Kinsella ..... H01H 9/563 307/139
7,504,916 B2 * 3/2009 Masaki ..... H01H 50/30 335/104
7,760,055 B2 * 7/2010 Adunka ..... H01H 3/001 335/8
7,852,178 B2 * 12/2010 Bush ..... H01H 50/023 335/126
7,859,373 B2 * 12/2010 Yamamoto ..... H01H 50/305 335/126
8,130,064 B2 * 3/2012 Moeller ..... H01H 50/546 335/131
8,138,863 B2 * 3/2012 Tanaka ..... H01H 50/38 335/195
8,179,217 B2 * 5/2012 Kawaguchi ..... H01H 50/20 335/80
8,248,193 B2 * 8/2012 Kaneda ..... F02N 15/067 335/126
8,614,611 B2 * 12/2013 Weeks ..... H01H 47/002 335/18
8,786,388 B2 * 7/2014 Ramezanian ..... H01H 50/54 335/196
8,941,453 B2 * 1/2015 Yano ..... H01H 50/54 335/131
9,059,523 B2 * 6/2015 Enomoto ..... H01H 50/38
9,064,664 B2 * 6/2015 Yamamoto ..... H01H 50/58
9,111,705 B2 * 8/2015 Schulte ..... H01H 3/001
9,159,512 B2 * 10/2015 Kodama ..... H01H 50/541
9,396,898 B2 * 7/2016 Kinsella ..... H01H 50/546
9,673,009 B2 * 6/2017 Yang ..... H01H 50/305
9,722,513 B2 * 8/2017 Bock ..... H01H 9/563
9,726,726 B2 * 8/2017 Bock ..... H01H 47/002
9,748,873 B2 * 8/2017 Bock ..... H01H 9/56
9,806,642 B2 * 10/2017 Bock ..... H02P 1/52
10,026,577 B2 * 7/2018 Hiroki ..... H01H 9/443
10,090,127 B2 * 10/2018 Ito ..... H01H 50/56
10,102,993 B2 * 10/2018 Guignot ..... H01H 50/56
10,134,551 B2 * 11/2018 Potter ..... H01H 50/546
10,153,115 B2 * 12/2018 Takaya ..... H01H 50/14
10,170,261 B2 * 1/2019 Tashima ..... H01H 50/546
10,176,953 B2 * 1/2019 Jefferies ..... H01H 3/222
10,361,051 B2 * 7/2019 Bock ..... H01H 9/563
2002/0135447 A1 * 9/2002 Gruner ..... H01H 51/2209 335/132
2004/0048521 A1 * 3/2004 Hogue ..... H01H 1/18 439/775
2004/0169976 A1 * 9/2004 Zhou ..... H01H 9/563 361/93.1
2006/0050466 A1 * 3/2006 Enomoto ..... H01H 50/02 361/160
2011/0221548 A1 * 9/2011 Yoshihara ..... H01H 51/29 335/185
2012/0188032 A1 7/2012 Wu
2013/0127571 A1 * 5/2013 Takaya ..... H01H 50/546 335/201
2014/0265995 A1 * 9/2014 Kinsella ..... H02P 1/32 318/778
2015/0015350 A1 * 1/2015 Tachikawa ..... H01H 50/18 335/131
2015/0022292 A1 * 1/2015 Tachikawa ..... H01H 49/00 335/131
2016/0049273 A1 * 2/2016 Jang, II ..... H01H 50/18 335/192
2017/0011864 A1 * 1/2017 Kroeker ..... H01H 1/50

OTHER PUBLICATIONS

Abstract of DE 43 15 754, dated Nov. 17, 1994, 1 page.
Extended European Search Report, European Patent Application No. 18206258.8, dated Mar. 20, 2019, 5 pages.

* cited by examiner

DOUBLE BREAKER SWITCH

CROSS-REFERENCE TO RELATED APPLICATION

This application claims the benefit of the filing date under 35 U.S.C. § 119(a)-(d) of German Patent Application No. 102017220503.2, filed on Nov. 16, 2017.

FIELD OF THE INVENTION

The present invention relates to an electrical switch and, more particularly, to a double breaker switch.

BACKGROUND

Electrical switches, such as contactors and relays, are suitable for closing or opening an electric circuit according to electrical control voltages. Electrical switches are used in numerous fields of application, including switching a high power which is controlled by a small power, separating different voltage levels, for example, low voltage at an input side and network voltage at an output side, separating direct-current and alternating-current circuits, simultaneously switching a plurality of circuits with a single control signal, and linking information and thereby constructing control procedures.

Switches for different switching tasks, for example, are used in the field of automotive electronics. Switches are used in vehicles with electric motors, such as, for example, battery electric vehicles (BEV), hybrid electric vehicles (HEV) or plug-in hybrid electric vehicles (PHEV). For example, a high-voltage contactor can be used in hybrid and electric vehicles in a medium power range. Such contactors can be used as main switches for a 400 V lithium ion accumulator and may be configured, for example, for a constant current of 175 A and a short-circuit capacitance of 5 kA. These high-voltage contactors meet the requirements for medium current loads.

A relay may be referred to as a single breaker switch while a double breaker switch is described as a contactor. A double breaker switch, for example, may have two fixed contacts which are securely connected to the switch and two bridge contacts which are fitted to a contact bridge movable in the switch. Relays are generally configured for relatively low switching powers and usually do not have any spark extinguishing chamber, while contactors are configured for relatively large switching powers and usually have a spark extinguishing chamber.

As a result of the relatively large switching powers, more massive contacts are usually necessary for contactors. If an electrical or electronic circuit does not suffer any damage at the outputs during a short-circuit, it is referred to as short-circuit resistance. The short-circuit resistance ensures that circuits are not damaged or destroyed by excess voltages or currents or thermal loads in the event of an overload or during short-circuits. The short-circuit resistance can be increased by powerful compression of the bridge contacts with the fixed contacts. A welding of the contacts or destruction of the double breaker switch at high short-circuit currents can thereby be avoided.

It is known from the publication "Investigations into the current-carrying capacity and the switching capacity of contact arrangements in non-hermetically-sealed switching chambers at 400 V" (21st Albert-Keil Contact Seminar, Karlsruhe, 28-30 Sep. 2011, VDE-Fachbereich 67, VDE VERLAG GMBH, Berlin, Offenbach) that a repelling force can be produced in the contact point between two separable contacts. In particular, FIG. 11 shows as a side view and FIG. 12 shows as a plan view schematic illustrations of the current paths according to this publication which cause the contact repulsion.

A solution to prevent perceptible noises and vibrations in a double breaker switch is known from WO 2014/093045 A1. Three surface contacts are provided on a movable bridge which are contactable with two fixed contacts. In particular, the arms of the contact bridge are symmetrical in order to transmit the force from an actuator.

Known solutions, however, require a large quantity of materials to increase short-circuit resistance over a service-life of the double breaker switch. Further, even the known double breaker switches that reduce perceptible noise still produce whistling noises, for example, as a result of rapid periodic load current changes.

SUMMARY

A double breaker switch comprises a contact bridge connected to an actuator at a connection point, a first fixed contact, and a second fixed contact. The contact bridge includes a first bridge contact connected to the connection point by a first arm and a second bridge contact connected to the connection point by a second arm. The second arm is longer than the first arm. The first bridge contact electrically connects with the first fixed contact at a first contact point in a closed state of the double breaker switch. The second bridge contact electrically connects with the second fixed contact at a second contact point and a third contact point in the closed state of the double breaker switch.

BRIEF DESCRIPTION OF THE DRAWINGS

The invention will now be described by way of example with reference to the accompanying Figures, of which.

DETAILED DESCRIPTION OF THE EMBODIMENT(S)

Figure 1:
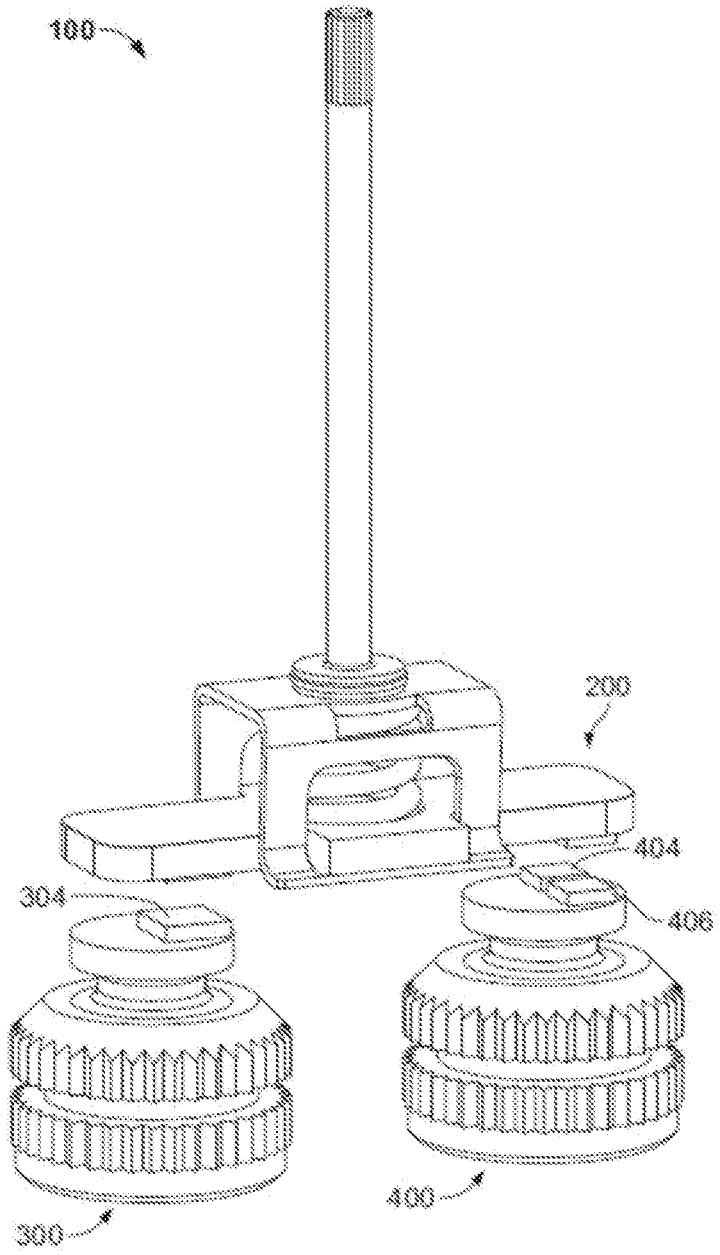
FIG. 1 is a perspective view of a double breaker switch according to an embodiment.

Embodiments of the present invention will be described hereinafter in detail with reference to the attached drawings, wherein like reference numerals refer to the like elements. The present invention may, however, be embodied in many different forms and should not be construed as being limited to the embodiments set forth herein; rather, these embodiments are provided so that the disclosure will be thorough and complete and will fully convey the concept of the invention to those skilled in the art.

A double breaker switch 100 according to an embodiment is shown in FIG. 1. The double breaker switch 100 includes a contact bridge 200, a first fixed contact 300, and a second fixed contact 400.

Figure 3:
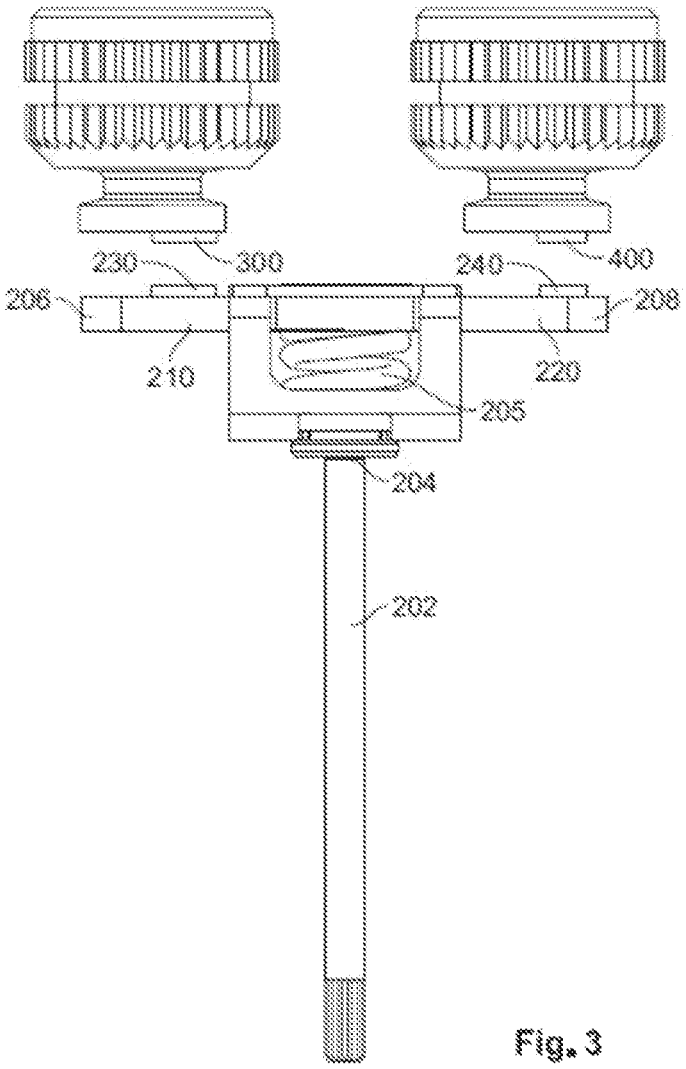
FIG. 3 is a side view of the double breaker switch.

The contact bridge 200, as shown in FIG. 3, includes a first arm 210 and a second arm 200 which are connected to a connection point 204 of the contact bridge 200. A first bridge contact 230 is disposed on the first arm 210 at a first bridge end 206 and a second bridge contact 240 is disposed on the second arm 220 at a second bridge end 208 opposite the first bridge end 206. In an embodiment, each of the fixed contacts 300, 400 and bridge contacts 230, 240 may have a silver or silver alloy portion.

Figure 4:
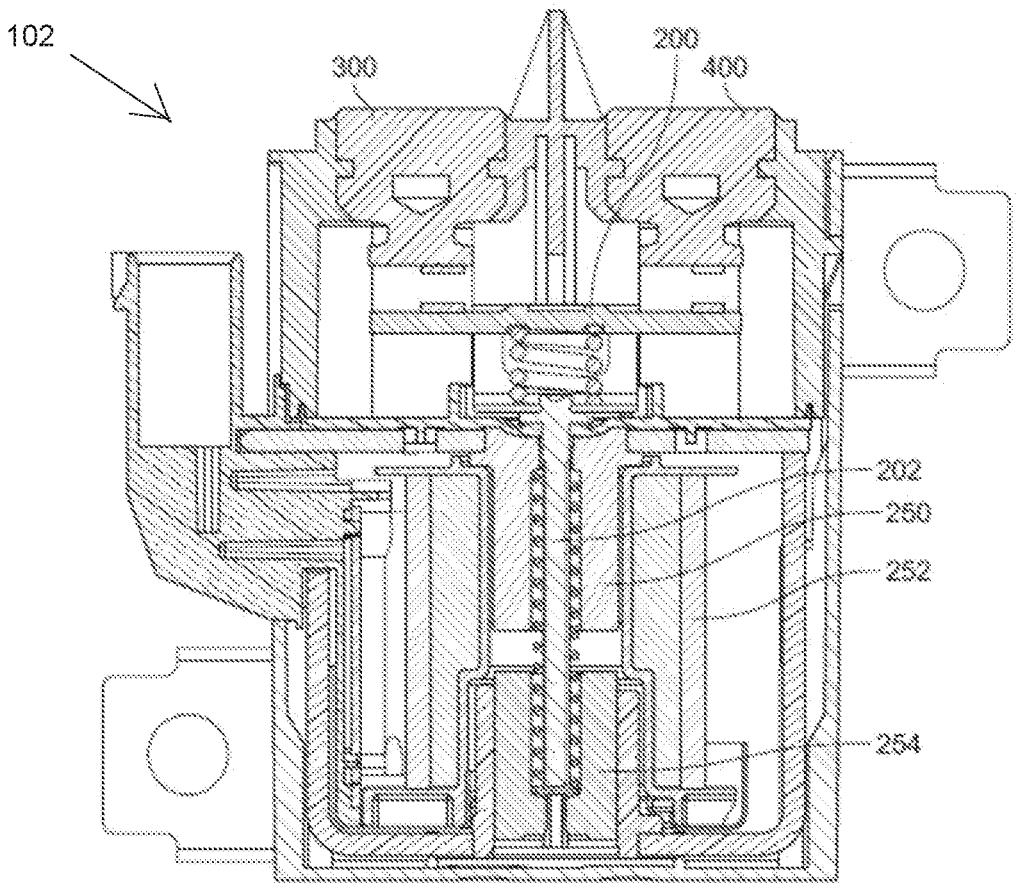
FIG. 4 is a sectional side view of a drive of the double breaker switch.

An actuator 202 is connected to the contact bridge 200 at the connection point 204 in a force-transmitting manner. The contact bridge 200 is resiliently connected to the actuator 202 by a resilient element 205 at the connection point 204. In the embodiment shown in FIG. 4, the actuator 202 is driven electromagnetically. An electromagnetic drive 102 for the actuator 202 has a core 250, a coil 252 and a lifting armature 254.

Figure 2:
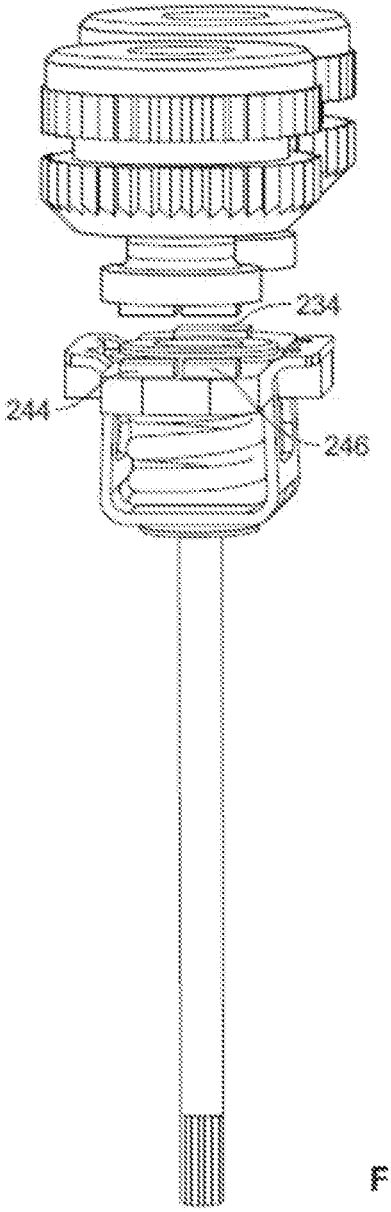
FIG. 2 is another perspective view of the double breaker switch.

In an open state of the switch 100, as shown in FIGS. 1-3, the first fixed contact 300 is opposite the first bridge contact 230 and the second fixed contact 400 is opposite the second bridge contact 240. In other embodiments, the bridge contacts 230 and 240 could also be arranged to be laterally offset relative to the fixed contacts 300 and 400 in the open state of the switch 100. In the open state of the switch 100, the current I is interrupted twice.

As shown in FIG. 1, the first fixed contact 300 is configured as a single contact with a first contact element 304. The second fixed contact 400 is configured as a double contact and includes a second contact element 404 and a third contact element 406. As shown in FIG. 2, the first bridge contact 230 is configured as a single contact with a fourth contact element 234. The second bridge contact 240 is configured as a double contact and includes a fifth contact element 244 and a sixth contact element 246. The second contact element 404 and the third contact element 406 and the fifth contact element 244 and the sixth contact element 246 each have a same dimension. In other embodiments, a double contact is configured only on the second fixed contact 400 or a double contact is configured only on the second bridge contact 240. Alternatively, it is also possible to configure both, that is to say, the second fixed contact 400 and the second bridge contact 240, as a single contact and in the closed state of the switch 100 to introduce an insulating device, for example, an insulating thread, between the contacted second fixed contact 400 and second bridge contact 240.

Figure 5:
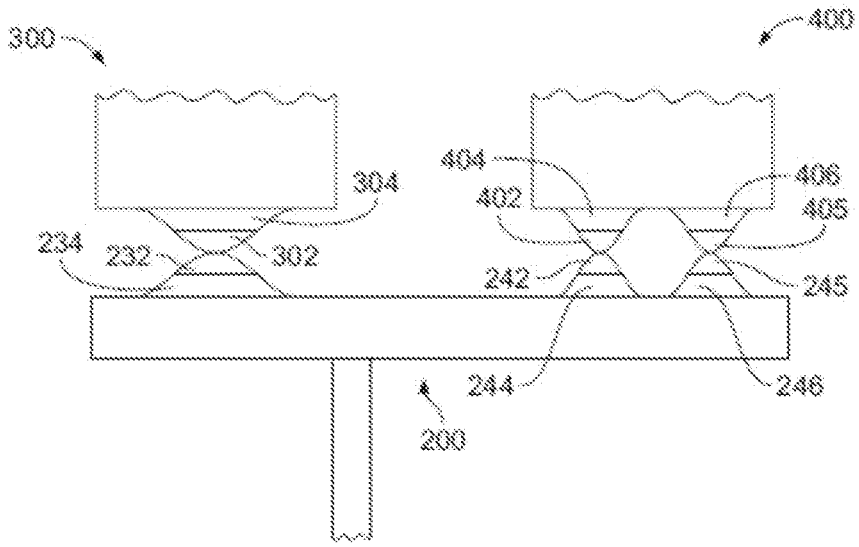
FIG. 5 is a side view of fixed contacts and bridge contacts of the double breaker switch.

As shown in FIG. 5, in an embodiment, each of the six contact elements 304, 404, 406, 234, 244, 246 is connected to a contact protrusion 302, 402, 405, 232, 242, 245. The contact protrusion can form a contact tip of the contact element. The first contact element 304 is connected to a first contact protrusion 302, the second contact element 404 is connected to a second contact protrusion 402, and the third contact element 406 is connected to a third contact protrusion 405. Further, the fourth contact element 234 is connected to the fourth contact protrusion 232, the fifth contact element 244 is connected to a fifth contact protrusion 242, and the sixth contact element 246 is connected to a sixth contact protrusion 245.

In the embodiment of FIG. 5, the contact protrusions 302, 402, 405, 232, 242, 245 are configured as rounded truncated cones. A circumference of each of the contact protrusions 302, 402, 405, 232, 242, 245 is smaller than the circumference of the contact elements 304, 404, 406, 234, 244, 246 which are connected to the contact protrusions. The contact elements 304, 404, 406, 234, 244, 246 thereby provide material which can erode as a result of contact fire during the service-life of the switch 100. Particularly as a result of the relatively great circumference of the contact element 304, 404, 406, 234, 244, 246 in comparison with the circumference of the contact protrusion 302, 402, 405, 232, 242, 245, the erosion of the material of the contact element is greater in terms of surface-area than in terms of the height. Consequently, over the service-life of the switch 100, the spacing of the contacts 230, 240, 300, 400 in the closed state of the switch 100 is reduced to a lesser extent than if the circumference of the contact element 304, 404, 406, 234, 244, 246 were to be equal to or less than the circumference of the contact protrusion 302, 402, 405, 232, 242, 245 and consequently would erode more powerfully in terms of the height over the service-life.

In an embodiment, a diameter of the contact protrusion 302, 402, 405, 232, 242, 245 is approximately 2 mm and a diameter of the contact element 304, 404, 406, 234, 244, 246 is approximately 5 mm, and there is a reduction of the height of the contact element 304, 404, 406, 234, 244, 246 of 0.2 mm over the service-life of the switch 100. Furthermore, a relatively large diameter of the contact element 304, 404, 406, 234, 244, 246 compared to a contact protrusion 302, 402, 405, 232, 242, 245 provides lateral tolerances. However, the repelling force between the opposing fixed contacts 300 and 400 and the bridge contacts 230 and 240 is increased as a result of a relatively large circumference of the contact element 304, 404, 406, 234, 244, 246.

In other embodiments, the contact protrusions 302, 402, 405, 232, 242, 245 do not necessarily have to be formed by a rounded truncated cone in order to be smaller in circumference than the contact element 304, 404, 406, 234, 244, 246. For example, the contact protrusion 302, 402, 405, 232, 242, 245 may be formed by a protrusion on the contact element 304, 404, 406, 234, 244, 246 and the contact element and the contact protrusion are produced integrally. In an embodiment, the contact protrusion 302, 402, 405, 232, 242, 245 has a cross-section which is constant over a height h of the contact element 304, 404, 406, 234, 244, 246. In other embodiments, the constant cross-section may be an elliptical, triangular, quadrilateral circumference, or any circumference which can be described, for example, by a polygon.

In the embodiment of FIGS. 1-4, the six contact elements 304, 404, 406, 234, 244, 246 of the bridge contacts 230 and 240 and the fixed contacts 300 and 400 are configured to be cuboid. The contact protrusions, in the embodiment of FIGS. 1-4, are configured centrally at opposite base faces of the contact elements 304, 404, 406, 234, 244, 246 of the fixed contacts 300, 400 and bridge contacts 230, 240. These base faces are square and have side lengths which are greater than the height of the contact elements 304, 404, 406, 234, 244, 246. In another embodiment, the contact elements 304, 404, 406, 234, 244, 246 are cylinders and the contact protrusions 302, 402, 405, 232, 242, 245 are arranged centrally on opposite circular faces of the cylinders. In this embodiment, the height of the cylinder is less than the diameter of the cylinder.

A contact element 304, 404, 406, 234, 244, 246 having a base face and a height can be used as a contact; both as a fixed contact and as a bridge contact. The base face and the circumference thereof can, for example, be a polygon. The base face contacts the opposing contact at a contact point, which is arranged centrally on the base face and is formed by the contact protrusion 302, 402, 405, 232, 242, 245. In this case, the central diameter of the base face is greater than the height of the contact element.

In another embodiment, the double breaker switch 100 includes a blow magnet and a spark extinguishing chamber in order to minimize wear as a result of switching arcs when the switch 100 is opened.

Figure 9:
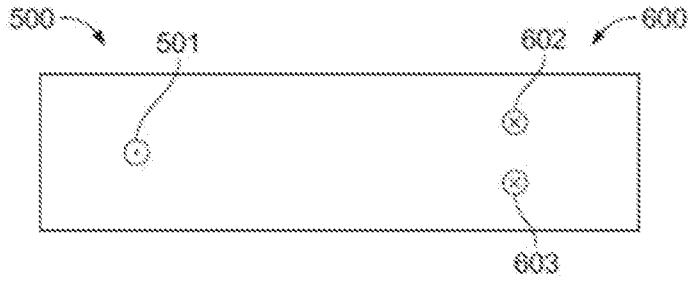
FIG. 9 is a schematic plan view of a plurality of contact points of a first contact arrangement and a second contact arrangement of the double breaker switch.
Figure 10:
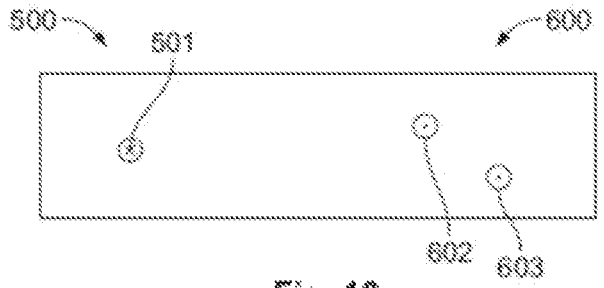
FIG. 10 is another schematic plan view of a plurality of contact points of a first contact arrangement and a second contact arrangement of the double breaker switch.
Figure 11:
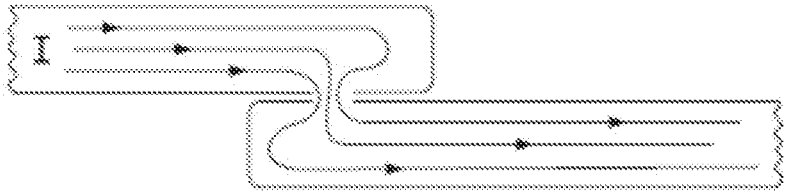
Fig. 11 (Prior Art)
FIG. 11 is a schematic side view of a plurality of current paths between contacts according to the prior art.
Figure 12:
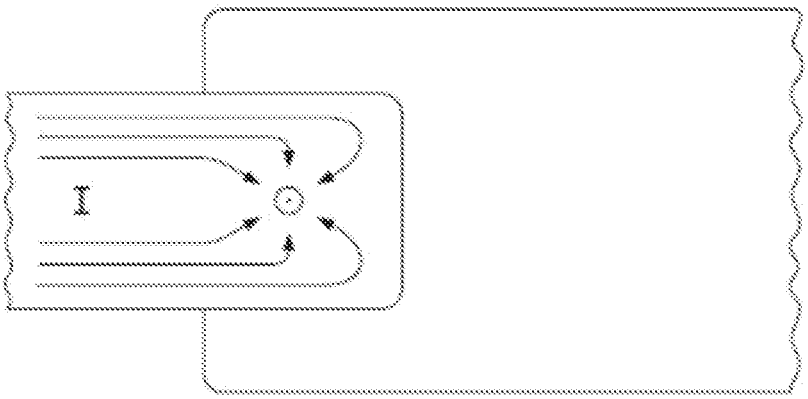
Fig. 12 (Prior Art)
FIG. 12 is a schematic plan view of the plurality of current paths of FIG. 11.

As shown in FIGS. 9 and 10, the switch 100 includes, in the closed state, a first contact arrangement 500 and a second contact arrangement 600.

The first contact arrangement 500, shown in FIGS. 9 and 10, includes a first contact point 501 which is formed in the closed state of the switch 100 by the first bridge contact 230 with the opposing first fixed contact 300. In an embodiment, the first contact point 501 is formed by the first contact protrusion 302 and the fourth contact protrusion 232.

The second contact arrangement 600, shown in FIGS. 9 and 10, includes a second contact point 602 and a third contact point 603 which are formed in the closed state of the switch 100 by the second bridge contact 240 with the opposing second fixed contact 400. The second contact point 602 is formed by the second contact protrusion 402 and the fifth contact protrusion 242 and the third contact point 603 is formed by the third contact protrusion 405 and the sixth contact protrusion 245.

Figure 6:
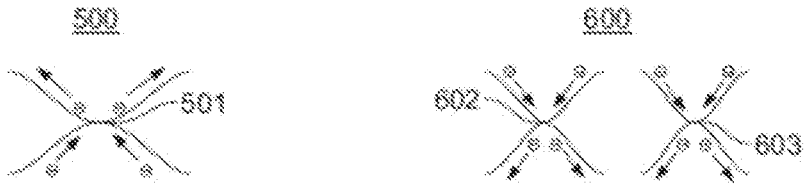
FIG. 6 is a schematic diagram of the movement of electrons in the fixed contacts and bridge contacts.

As shown in FIG. 6, negatively charged electrons flow through the first contact arrangement 500 and the second contact arrangement 600. Alternatively, these effects could also be depicted by positive hole conduction. Because the circumference of the fixed contacts 300, 400 and bridge contacts 230, 240 is greater than the circumference at the contact points 501, 602, 603, in order to flow through the contact points 501, 602, 603, the current I is focused at one side of the contact point 501, 602, 603 and defocused at the opposite side of the contact point 501, 602, 603. A radially symmetrical field is formed wherein the contact point 501, 602, 603 forms the center point of the field. The directions of the currents in the opposing fixed contacts 300, 400 and bridge contacts 230, 240 are each opposed because the current flows once towards the contact point 501, 602, 603 and flows away from the contact point 501, 602, 603 at the opposite side.

The electrons are concentrated moving toward the contact points 501, 602 and 603 and the electrons diverge moving away from the contact points 501, 602 and 603. The mutually opposing charges form opposing magnetic fields which result in a repelling Lorentz force in each of the contact points 501, 602 and 603. Consequently, a repelling force F is produced between each of the fixed contacts 300, 400 and bridge contacts 230, 240 in such a double breaker switch 100 in the closed state. In this case, the force F in the contact point 501, 602, 603 is generally proportional to the square of the strength of the current I, that is to say, F~I2. The repelling force F is proportional to the logarithm resulting from the ratio of the contact element diameter and the actual metallically conductive contact touching points.

Figure 7:
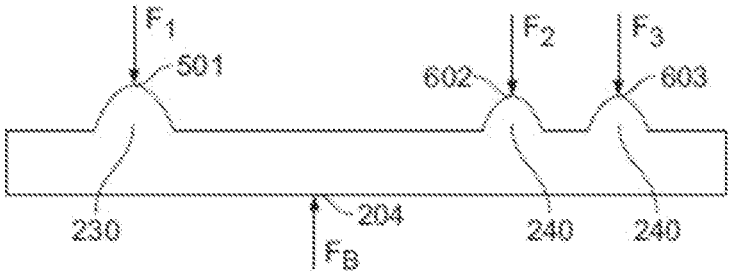
FIG. 7 is a schematic diagram of forces acting on a contact bridge of the double breaker switch.

The forces which act on the contact bridge 200 are shown in FIG. 7. A force F1 acts in the first contact point 501 on the first bridge contact 230, a force F2 acts in the second contact point 602 on the second bridge contact 240, and a force F3 also acts in the third contact point 603 on the second bridge contact 240. A force FB which is transmitted by the actuator 202 acts at the connection point 204 in the opposite direction on the contact bridge 200. It is clear to the person skilled in the art that forces also always generate counter-forces with an opposing direction in accordance with the principle of action and reaction, which are not illustrated in FIGS. 7 and 8 for reasons of clarity.

If the current I is carried by the first contact arrangement 500 and by the second contact arrangement 600, the force F1 which acts on the first arm 210 and the force F2,3 which acts on the second arm 220 can be calculated. The first repelling force $F1=k*I^2$ acts between the first bridge contact 230 and the first fixed contact 300, wherein k is a constant. In the second contact arrangement 600, the current I can be divided over the second contact point 602 and the third contact point 603. The current I may be divided uniformly over the second and third contact points 602, 603, that is to say, a current J=I/2 flows through each of the second and third contact points 602, 603. Consequently, a force $F2=m*J^2=m*I^2/4$ then results for the second contact point 602 and a force $F3=n*J^2=n*I^2/4^2$ then results for the third contact point 603, wherein m and n are constants. Therefore, a repelling force F2,3=(F2+F3) acts between the second bridge contact 240 and the second fixed contact 400. Without considering the constants, that is to say, for example, in the case k=m=n, the result is that the force on the second arm 220 is reduced in that the current I is carried uniformly by two contact points 602, 602. Particularly in the case J=I/2, the force F2,3 is halved.

The forces are also dimensioned by the values of the constants k, m and n. The constants k, m and n also take into consideration at least properties of the fixed 300, 400 and bridge contacts 230, 240. The constants particularly take into consideration the shape of the fixed 300, 400 and bridge contacts 230, 240; the shape contains variables such as the circumference of the fixed and bridge contacts and properties of the surfaces of the opposing fixed and bridge contacts. For example, the repelling force increases with the circumference of the fixed 300, 400 and bridge contacts 230, 240. A property of the surface may be the radius of curvature, by which the contact point is formed on the fixed 300, 400 or bridge contacts 230, 240.

Figure 8:
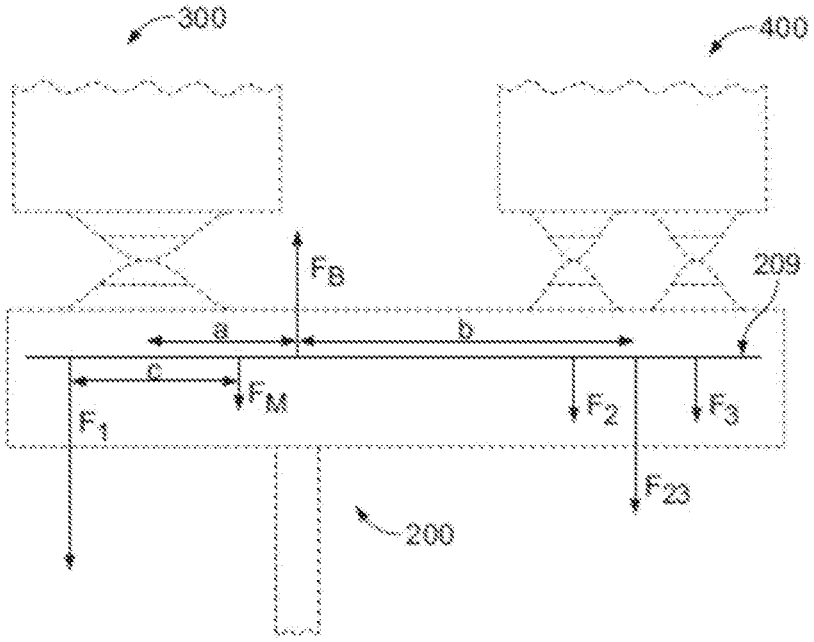
FIG. 8 is a schematic diagram of forces acting on the contact bridge and the fixed contacts.

FIG. 8 shows the resultant forces which act on a notional auxiliary plane 209. The auxiliary plane 209 is located inside the contact bridge 200. In another embodiment, the auxiliary plane is at the three contact points 501, 602 and 603. The auxiliary plane 209 establishes the resultant forces which act on the first arm 210 and the second arm 220. The lever principle is used for the calculation. The first force F1 which acts on the auxiliary plane 209 and the force of the actuator FB acting on the auxiliary plane 209 are connected by the lever arm a. The forces F2 and F3 can be expressed as a force F23. The force F23 which acts on the auxiliary plane 209 and the force of the actuator FB acting on the auxiliary plane 209 are connected by the lever arm b. In the event that forces can be disregarded as a result of a blow magnet FM, it is then found that FB must be $\geq a*F1+b*F23$ in order to retain the switch 100 in a closed state.

The same current I flows in the closed state through the first contact arrangement 500 and the second contact arrangement 600. Since the second contact arrangement 600 has two contact points 602 and 603 and the force is proportional to the square of the current strength, it follows F23<F1 and as an extreme value F23=0.5*F1 if the current I is divided uniformly and contact properties are disregarded. Consequently, it is the case for a lever arm b which is longer than the lever arm a that the force FB which the actuator 202 has to apply is reduced. Consequently, the cooperation of the first contact arrangement 500 with the first arm 210 and the second contact arrangement 600 with the second arm 220 results in the effect that the force FB which has to be applied by the actuator 202 is minimized.

Other effects, such as, for example, the presence of a force FM shown in FIG. 8 which is produced by a blow magnet, can be taken into consideration in a similar manner. In particular, to this end the lever principle can also be used. For example, the force F1 can be connected to the force FM via the lever arm c. In particular, different lengths of the arms 210 and 220 can thereby be produced. In an embodiment, $a<b<2*a$.

As shown in FIGS. 1-4 and 9, the three contact points 501, 602, and 603 form an equal-sided triangle. An alternative contact arrangement in which the contact points 501, 602, and 603 form an irregular obtuse triangle is shown in FIG. 10. In another embodiment which is not shown, the three contact points 501, 602, and 603 form an irregular acute triangle.

The double breaker switch 100 always forms a three-fold contact. More than three contact points 501, 602, and 603 are not possible because the system would otherwise be overdetermined and would not contact at least one point. Furthermore, the three contact points 501, 602, 603 are not located on a straight line but instead define a plane.

What is claimed is:

1. A double breaker switch, comprising:

a contact bridge connected to an actuator at a connection point, the contact bridge including a first bridge contact connected to the connection point by a first arm and a second bridge contact connected to the connection point by a second arm, a distance between the second bridge contact and a center of the contact bridge being greater than a distance between the first bridge contact and the center of the contact bridge;

a first fixed contact, the first bridge contact positioned to electrically connect with the first fixed contact at a first contact point in a closed state of the double breaker switch; and a second fixed contact, the second bridge contact positioned to electrically connect with the second fixed contact at a second contact point and a third contact point in the closed state of the double breaker switch.

2. The double breaker switch of claim 1, wherein the first bridge contact and the second bridge contact are electrically connected.

3. The double breaker switch of claim 1, wherein the first bridge contact is disposed at a first bridge end of the bridge and the second bridge contact is disposed at a second bridge end of the bridge opposite the first bridge end.

4. The double breaker switch of claim 1, wherein the first contact point, the second contact point, and the third contact point define a plane.

5. The double breaker switch of claim 4, wherein a force transmitted by the actuator to the contact bridge is in a direction perpendicular to the plane.

6. The double breaker switch of claim 1, wherein the first contact point, the second contact point, and the third contact point define a triangle having a pair of equal sides.

7. The double breaker switch of claim 1, wherein at least one of the first fixed contact, the second fixed contact, the first bridge contact, and the second bridge contact includes a contact protrusion connected to a contact element.

8. The double breaker switch of claim 7, wherein a circumference of the contact protrusion is less than a circumference of the contact element.

9. The double breaker switch of claim 1, wherein at least one of the first fixed contact, the second fixed contact, the first bridge contact, and the second bridge contact has a silver or silver alloy portion.

10. The double breaker switch of claim 1, wherein at least one of the second fixed contact and the second bridge contact includes multiple individual contact elements.

11. The double breaker switch of claim 10, wherein the multiple individual contact elements each have a same dimension.

12. The double breaker switch of claim 10, wherein the at least one of the second fixed contact and the second bridge contact includes multiple contact protrusions with each contact protrusion connected to one of the individual contact elements.

13. The double breaker switch of claim 1, further comprising an electromagnetic drive for the actuator.

14. The double breaker switch of claim 1, further comprising a blow magnet.

15. The double breaker switch of claim 1, wherein a length of the second arm is less than or equal to twice the length of the first arm.

16. The double breaker switch of claim 1, wherein the second fixed contact includes two individual contact elements and the second bridge contact is a single contact element.

17. The double breaker switch of claim 1, wherein the second bridge contact includes two individual contact elements and the second fixed contact is a single contact element.

18. The double breaker switch of claim 1, wherein the second fixed contact and the second bridge contact each include two individual contact elements.

19. The double breaker switch of claim 1, wherein the second bridge contact is arranged closer to an end of the second bridge than the first bridge contact is arranged with respect to an end of the first bridge, and a first contact element of the first fixed contact is arranged closer to the center of the contact bridge than a second contact element of the second fixed contact.

20. The double breaker switch of claim 19, wherein the first contact element is arranged on the first fixed contact in a position laterally offset from a center of the first fixed contact in a direction toward the center of the contact bridge, and the second contact element is arranged on the second fixed contact in a position laterally offset from a center of the second fixed contact in a direction away from the center of the contact bridge.

* * * * *